US005974991A

United States Patent [19]

Bardsley

[11] Patent Number: 5,974,991

[45] Date of Patent: Nov. 2, 1999

[54] CONTROLLED NEEDLE TOFTING MACHINE

[75] Inventor: Harold B Bardsley, Lancashire, United Kingdom

[73] Assignee: Spencer Wright Industries, Inc., Dalton, Ga.

[21] Appl. No.: 08/937,550

[22] Filed: Sep. 25, 1997

[30] Foreign Application Priority Data

Mar. 22, 1996 [GB] United Kingdom ..... 97060115
Mar. 22, 1996 [GB] United Kingdom ..... 97060123

[51] Int. Cl.[6] ..... D05C 15/04; D05C 15/18

[52] U.S. Cl. ..... 112/80.45

[58] Field of Search ..... 112/163, 226, 112/222, 224, 225, 80.4, 80.41, 80.43, 80.44, 80.45, 80.5, 80.7, 80.72, 80.73

[56] References Cited

U.S. PATENT DOCUMENTS 3,978,800 9/1976 Card et al. ..... 112/80.4 X
4,154,176 5/1979 Spanel et al. ..... 112/80.45
4,637,329 1/1987 Czelusniak, Jr. ..... 112/80.45
4,790,252 12/1988 Bardsley ..... 112/80.43 X
4,852,505 8/1989 Dedmon ..... 112/80.43 X
4,860,674 8/1989 Slattery ..... 112/80.42
5,653,184 8/1997 Bardsley ..... 112/80.01
5,662,054 9/1997 Bardsley ..... 112/80.43 X

*Primary Examiner*—Ismael Izaguirre
*Attorney, Agent, or Firm*—Alan Ruderman; Stephen J. Stark

[57] ABSTRACT

An individually controlled needle tufting machine has a reciprocable latch bar for latching and unlatching selective needle holders, each needle holder being guided between a pair of guide plates and carrying a respective needle so that each needle selectively may be driven by the latch bar. The guide plates each include a plurality of curvilinear ridges and the edges of the needle holder are curvilinear and are received within a respective spaced apart pair of ridges within which they are guided as the needle holder reciprocates. The plates include vertically spaced apart inserts within which the ridges are formed. The needle holder has a yarn clamp mounted internally adjacent the bottom and a leaf spring has a leg mounted externally of the holder and has a leg entering internally to act upon and urge the yarn clamp.

12 Claims, 2 Drawing Sheets

CONTROLLED NEEDLE TOFTING MACHINE

BACKGROUND OF THE INVENTION

This invention relates to tufting machines and more particularly to a tufting machine wherein the needles are carried by needle holders which are selectively latched to a reciprocating latch bar, the needle holders being mounted between guide plates adjustably mounted in the machine.

Tufting machines which produce carpet, basically include a large frame having a head within which a rotatable mainshaft is mounted and from which needle driving structure is supported for reciprocating a multiplicity of needles. The frame also includes a bed within which oscillating loopers or hooks are mounted for cooperating with the needles to form loops of yarn, knives being used in conjunction with the hooks to cut the loops in many tufting machines. As the tufting art has developed, there have been a substantial number of innovations to obtain unique patterning effects. One such innovation has been to shift the needles laterally in accordance with a pattern. Another innovation has been to provide each needle with a sew/no-sew capability by mounting the needles on individual needle holders which are reciprocated selectively by either being latched to or disengaged from a reciprocating latch bar, the latter being reciprocably driven continuously from mechanism driven by the rotating mainshaft. When latched to the latch bar, the needle reciprocates into cooperation with the hook to form a loop. The latching occurs by means of latch pins on pneumatic cylinders driven in accordance with a pattern. Machines of this type are known as controlled needle machines, and when each needle is individually controlled in this manner, it is known as an individual controlled needle machine.

A recent development in the tufting art is to combine the individual control needle machine concept with the shifting needle concept, and to feed the backing material intermittently. This provides a tufting machine wherein the needles may be threaded with a number of different yarns, e.g., yarns of different colors, and a needle having a yarn of a particular color may be inserted into the backing at any of a selected number of locations so that extremely precise multi-color patterns may be produced similar to the fine woven carpets produced by looms. A machine of this type is illustrated in Bardsley U. S. Pat. No. 5,653,184.

In such tufting machines, as illustrated in the aforesaid patent, the needles are individually mounted in an elongated holder, one end of which is adapted for latching to the latch bar and the other end of which mounts the needle. The needle holder is normally biased by a return spring into a non-sewing position and is driven into a sewing position during sewing against the bias of the spring by the needle drive arrangement. The needle holder includes a spring biased ratchet-like clamp arrangement which causes the yarn to be drawn from the supply when the needle holder moves from the non-sewing position to the sewing position by trapping the yarn between the clamp and a wall of the holder. When the needle holder moves back to the non-sewing position, the tension on the yarn urges the clamp away from the wall of the holder so that the yarn can pass through the clamp.

A problem that has arisen with this construction of the prior art is that the ratchet-type clamp of the needle holder is in a position whereby access to the spring for removal or replacement is difficult. In a majority of cases if these parts fail or need replacement, it has been necessary immediately to replace the entire needle holder, thereby increasing cost of replacement parts and machine down-time. The spring in the prior art is within the body of the needle holder or within an extension secured to the needle holder, the extension having a deep slot milled between two thin wall portions. Pins within the slot must be positioned so as to guide yarn and hold the ratchet-type mechanism and spring within the slot. A coil spring having two legs one of which is disposed about the pin on which the clamp is journalled and the other of which is disposed about another pin so as to bias the clamp against the yarn is disposed within the slot. The slot within the needle holder is milled so as to leave a little material at the end to permit a hole to be formed for mounting the pin about which the spring is curled.

Moreover, the needle holder on such machine is mounted for movement by means of a pair of ridged guide blocks or plates having parallel channels therein. The guide bars or plates are secured to a top and bottom surface of a needle support bar and the ridges or channels in the guide plates define therebetween positions in which respective needle holders can be mounted. A corresponding ridged pair of fixing plates are secured to a top and bottom surface of a fixing bar and can be secured in a position relative to the guide plates so that the needle holders are secured in position in a tufting machine intermediate respective ridges formed in the guide plates and fixing plates. Each of the fixing and guide plates is adjustable relative to the needle support bar and/or fixing bar in order to allow the needle holder to be adjusted to ensure accurate alignment with the drive mechanism. The drive plates and fixing plates may be modular in so far as they have a width such that each plate retains only a small number of needle holders in position in the machine.

The arrangement of the mounting blocks in the prior art is such that the needle holders cannot be removed readily from the tufting machine in a direction transverse to the direction of reciprocation, and thus in order to remove the needle holder it is presently required to penetrate the backing material, cut an opening and remove the needle holder in the vertical or reciprocation direction.

A problem arises with this existing mounting system since the correct alignment of the needle holder and the drive mechanism are dependent upon the relative positioning of at least four plates, thereby making it difficult and time consuming to achieve such correct alignment.

Additionally, thermal expansion may cause the guide plates and/or the needle holder to vary in shape or dimension. If the needle holder has a straight or dovetail cross sectional configuration as in the prior art, such expansion may result in the needle holder becoming misaligned by twisting or rotating slightly in the guide. The thermal expansion resulting in such variation may be caused by frictional heating of the guide plate and/or the fixing plate during operation.

SUMMARY OF THE INVENTION

Consequently, it is a primary object of the present invention to provide an improved needle mounting system and needle holder for a tufting machine having needle holders which may be individually latched to a reciprocating drive bar selectively.

It is another object of the present invention to provide a needle mounting system for a tufting machine having needles mounted individually in needle holders reciprocable between guide members and which may be selectively latched to a reciprocating drive bar, the needle mounting system permitting adjustments of the guide plates to allow correct positions and alignment to ensure accurate reciprocation of the needles.

It is a further object of the present invention to provide an improved needle holder for a tufting machine having needles which have sew/no-sew capability in which the yarn drawing ratchet clamp is biased by a spring mounted externally of and readily removeably attached to the needle holder.

It is a further object of the present invention to provider a needle mounting system for a tufting machine having needles which may be latched to or unlatched from a reciprocating drive bar, needle holder guide elements and needle holders having cooperating arcuate surfaces to prevent twisting of the needle holders in the guides due to thermal expansion or the like.

It is a yet still further object of the present invention to provide a needle mounting system including guide plates between which needle holders may reciprocate, the guide plates having guide elements which may be adjustable to ensure correct alignment and which is constructed to permit the guide elements to be released so that the needle holder may be removed from a tufting machine transversely of the direction of reciprocation thereof.

Accordingly, the present invention provides an improved mounting for a needle in a controlled needle or sew/no-sew tufting machine, the mounting including a holder from which a needle depends at one end, and the second end of the holder being adapted for driving connection to a reciprocating drive of the tufting machine. A ratchet type clamp which is normally biased by a spring into a position in which yarn may be drawn from a supply during a movement of the needle holder as it moves to the sewing position into a fabric to cooperate with a hook and is prevented from moving as the needle holder and needle move away from the fabric and the hook on which the yarn has been seized is provided with a biasing spring mounted externally of and removeably attached to the holder. This construction makes it possible to provide a mounting for a needle in a controlled needle machine in which parts thereof which are prone to mechanical breakage may be removed and replaced without the necessity to replace the entire needle holder.

The needle mounting system includes a guide plate mounted on or adjacent a needle support bar of the tufting machine and a fixing plate is removeably secured relative to the guide plate to secure at least one needle holder in position between the fixing plate and the guide plate. The needle holder is drivingly linked to a drive mechanism which is operable to selectively reciprocate the needle for sewing. The guide plate and fixing plate respectively comprise a pair of guide or fixing elements connected so as to be adjustable as to position relative to the drive mechanism thereby to ensure correct alignment relative to the drive mechanism whereby the needle holder is driven in an accurate path and the needle may cooperate with the respective hook. This arrangement allows simple adjustment of the guide plate relative to the drive mechanism for the needle holders to provide accurate alignment of the holder with the drive mechanism and thereby ensure accurate driving of the needle holders during operation of the tufting machine.

Preferably the guide and fixing elements are ridged so as to define a plurality of channels therebetween in which the needle holders can be mounted, the channels being substantially curved in cross section and the front and back edges of the needle holder are also substantially curved. Thus, the needle holder during sewing is less prone to jamming than in the prior art, and furthermore, less frictional heat is generated which may cause distortion of the guide and/or fixing plate which itself would tend to increase the likelihood of jamming. Preferably, the front and back edges of the needle holder in cross section and the channels in the guide and fixing plate have a configuration which is a portion of a circle, i.e., an arcuate shape with a fixed radius.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
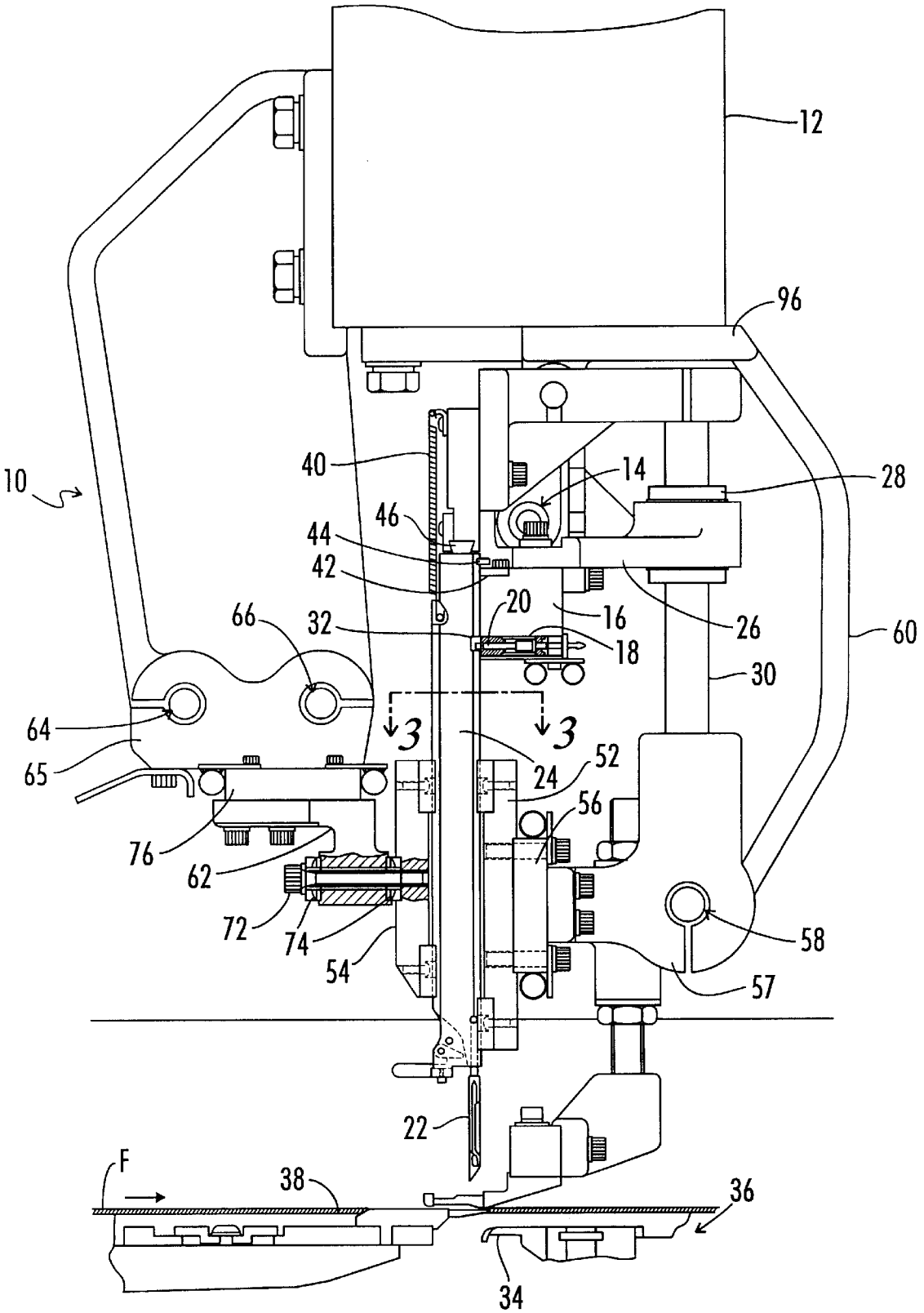
FIG. 1 is a fragmentary side elevational view of a tufting machine incorporating the needle holder and holder mounting arrangement constructed in accordance with the principles of the present invention.

Referring to the drawings, FIG. 1 illustrates a tufting machine 10 incorporating apparatus constructed in accordance with the principles of the present invention. The machine includes a laterally elongated head 12 within which a plurality of longitudinally spaced push rods (not illustrated) are mounted for reciprocation. The push rods are reciprocably driven by drive mechanism in the head 12 substantially identical to that disclosed in U.S. Pat. No. 4,860,674. The lower end of the push rods are connected to the rods of linear bearings 14, only one of which is illustrated, the housing of the bearings being secured to a latch bar 16 which thus reciprocates with the push rods and may move transversely relative thereto. Alternatively, the push rods may be connected to push rod feet to which the linear bearings are connected. In either case, the latch bar may be reciprocated and shifted transversely. The latch bar has a multiplicity of air cylinders 18 with cylinder actuated latch pins 20 that may be selectively extended from or retracted into the latch bar in accordance with a pattern as disclosed in Bardsley U.S. Pat. No. 4,790,252 in a manner well-known in the art.

Figure 2:
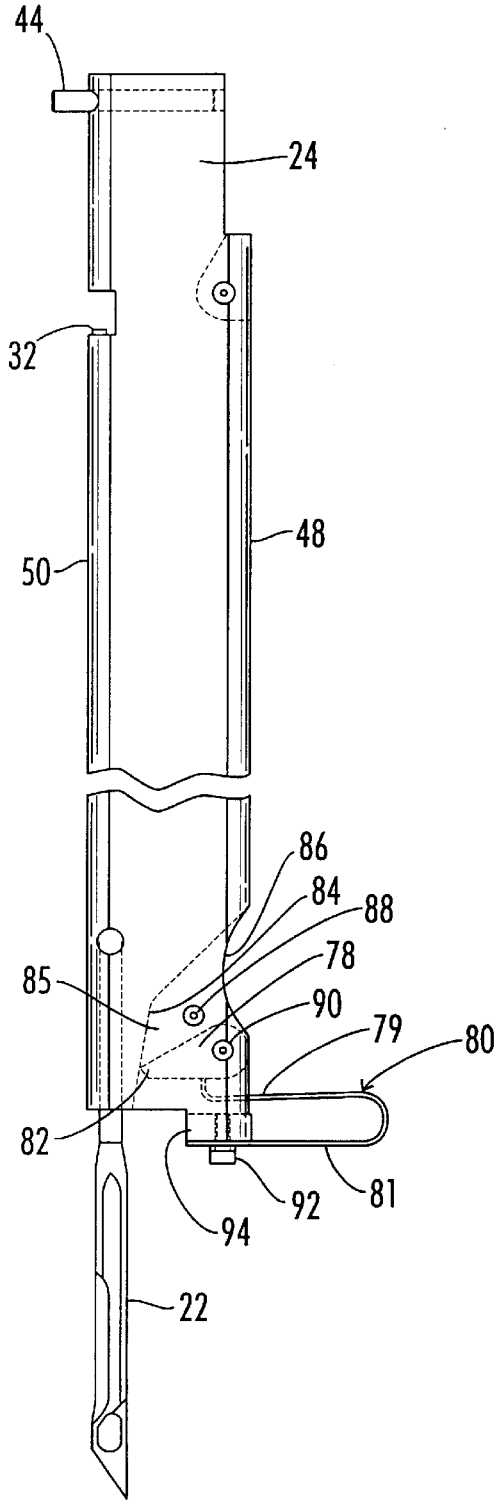
FIG. 2 is a side elevational view of a needle holder illustrated in FIG. 1 greatly enlarged in relation thereto.

The tufting machine incorporates a separately controlled latch pin 20 corresponding to each tufting needle 22 in the machine, and is thus known as an individually controlled needle tufting machine. Each needle is mounted within and extends from a separate needle holder 24 to which further reference will be had. The latch bar is secured to a moveable arm 26 having a linear bearing 28 at an end remote from the latch bar 16 and is moveable vertically about a support strut or rod 30. The cylinder 18 is pneumatically operated to extend and retract the latch pin 20. When the latch pin is extended it may engage the needle holder 24 to allow selective driving of the needle holder. To facilitate this, the needle holder includes a notch 32, best illustrated in FIG. 2, into which the pin of a respective cylinder may selectively engage to drive the needle holder. When the needle holder is driven downwardly, the needle penetrates a backing material F to cooperate with a hook 34 located in the bed 36 of the tufting machine as is conventional to form tufts in the backing material fed over a bedplate 38.

A spring 40 is connected between the needle holder 24 and a vertically fixed member of the machine so that movement of the needle holder 24 downwardly during reciprocation by the drive mechanism is biased by the spring 40 and the needle holder is normally returned to a starting position by a tab 42 on the latch bar for engaging a lug 44 secured to and extending out of the needle holder 24 at the top thereof, and the spring acts to urge the needle holder upwardly against an abutment member 46 on a frame member to which the upper end of the spring is secured.

The needle holder 24 comprises an elongated one-piece metallic member and the needle 22 may be either releasably secured in position by means of a releasable screw (not illustrated) as is conventional, or alternatively the needle can be bonded to the holder using any suitable bonding material which would secure the needle in the holder and be releasable if necessary for replacement. The needle holder 24 has substantially curved front and rear edges 48, 50 for reasons hereinafter made clear, and is mounted between a guide plate 52 and a fixing plate 54 and may be reciprocated vertically as guided by these plates. The guide plate 52 is mounted to a needle support bar 56 which is attached by an arm 57 to the housing of a linear bearing 58, the rod of the bearing being fixedly attached to the head 12 of the machine by means of a linkage member 60 which may have a curved configuration as illustrated or may be of any other suitable shape. The linear bearing permits the needle support bar 56 and thus the guide plate 52 to slide transversely, the linear bearing housing also supporting the strut 30 so when the latch bar 16 is shifted transversely so to do other elements such as the needle support bar, the guide plate and the needle holder. The fixing plate 54 is releasably secured to a fastening bracket 62 which is connected by a rail 63 and clamp arm 65 to linear bearings 64, 66 slidable within a housing so that the fixing plate 54 also moves as a unit with the guide plate 54 and the needle holder 24.

Figure 3:
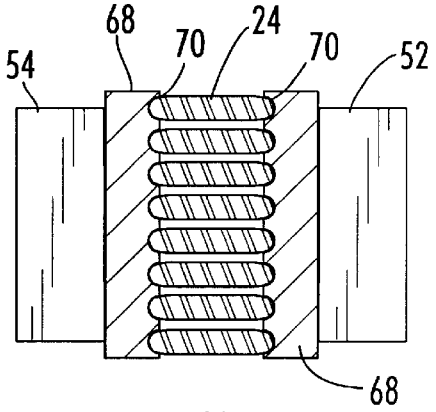
FIG. 3 is a cross sectional view taken substantially along line 3—3 of FIG. 1.
Figure 4:
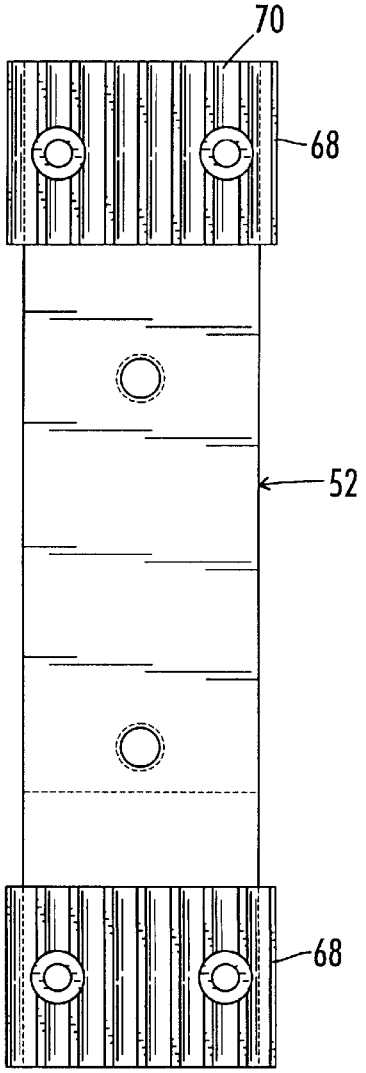
FIG. 4 is an elevational view depicting a guide plate illustrated in FIG. 1.

The guide plate 52 and fixing plate 54 are substantially identical and as illustrated in FIGS. 3 and 4 have removable guide insert elements 68 provided at each end thereof. The guide elements 68 have a plurality of substantially parallel, substantially uniformly spaced ridges 70 therein which define a plurality of substantially parallel, substantially uniform spaced channels therebetween. The ridges 70 in the inserts 68 are curvilinear in cross section with a fixed radius, and so to are the front and back edges 48, 50 of the needle holder 24. The removable insert elements 68 are formed from a plastic material having high temperature stability, low friction characteristics such as polyether-ether ketone with carbon fiber and PTFE fillers, the hardness being sufficient so as not to be subject to excessive wear during use. Preferably, the guide and fixing plates 52, 54 are of such size as to secure between approximately 10 to 12 needle holders in position, each guide plate 52 being of the same dimension and associated with one fixing plate.

The curved edges of the needle holder and the ridges 70 of the inserts locates the needle holder 24 in the channels while allowing a small variation in relative position of the guide plates and fixing plates 52, 54 from an ideal or absolute alignment without jamming. This variation may be due to thermal expansion caused by frictional heating of the guide and/or fixing plates during sewing or tufting. The shape is particularly advantageous since when the edges are located in the ridges of the channels, the edges of the needle holder 24 are permitted to roll slightly within the channel about the longitudinal axis of the holder. This allows a small variation and position of the guide and fixing plates 52, 54 without increasing the degree of friction during movement of the holder while the machine is sewing or tufting, i.e., a small amount of angular movement of the needle holder 24 may occur relative to the guide and fixing plates without significantly increasing the likelihood of locking or jamming during reciprocation. This renders the needle mounting system of the present invention easier to set up in a more accurate manner than the prior art since a small amount of movement of the fixing plate 54 in a direction transversely of the ridges is possible relative to the guide plate 52 with minimal effect on needle position, accuracy of driving the needle holder and no significant increase in friction.

The fixing plate 54 is releasably secured in position relative to the guide plate 56 by way of a fastener member 72 which includes one or more spherical washers 74 which allow the releasable connection of the plate to the bracket not withstanding small angular inclinations between the fastener member and the fastening bracket 62. This arrangement means that, after the guide plate 56 has been fixed in position relative to the drive mechanism for the needle holder 24, the fixing plate 54 is capable of being fixed in a suitable position relative to the guide plate 52 to secure the needle holders 24 in place not withstanding that the fixing plate may have to be positioned at a small angle relative to the fastening bracket 62. Therefore, this arrangement obviates the need for absolute accuracy in the relative positions of the needle support bar 56 and the rail 63 to which the fastening bracket 62 is secured when assembling the tufting machine while allowing the needle holder 24 to be accurately aligned with the drive mechanism for accurate reciprocation of the needle. Furthermore, and significantly, this arrangement also facilitates ease of removal of the needle holder 24 from the machine for replacement. This ability arises due to the fact that the fixing plate 54 is removable completely and therefore both inserts 68 are released from contact with the needle holder 24 to enable the needle holder to be removed from the tufting machine transversely of the direction of reciprocation easily without the necessity for the needle holder to penetrate the backing fabric as in prior art constructions. In the prior art, for example, if a needle holder is to be removed, a hole must be made in the backing fabric and the needle holder dropped through the backing.

At the lower end of the needle holder 24, adjacent the needle 22, the present invention provides a ratchet clamp arrangement comprising a pivoted ratchet clamping member 78 which is biased by a spring clip 80 in the form of a leaf spring into a position in which yarn is trapped between a nose or leading edge 82 of the clamp and a side wall 84 formed in the needle holder by a spark eroding process. Thus, an opening 86 is provided in the needle holder adjacent the lower end thereof to form a recess 85 within the body of the needle holder. Thus, during the downward movement of the needle holder 24 from an upper position to the sewing position, yam is pulled from the supply by the needle as the nose 82 of the clamp 78 traps the yam within the holder against the wall 84. On the upward movement of the needle holder the yam extending from the supply to the hook 34 is held by the hook so that the yarn urges the clamp 78 against the bias of the spring 80 and permits the clamp to ride over the yarn. The yarn is guided about a small pin 88, and the clamp 78 is pivoted by a stepped rivet or the like 90

The spring clip 80 is a flat metallic member and has a substantially U-shaped configuration in elevation with an outwardly extending bend on the leg 79 acting against the clamp 78, the leg 79 of the spring extending into the recess 85 through the opening 86 which, it may be noted, extends from an arcuate portion down toward the bottom of the needle holder so that the leg 79 of the spring may enter to act against the clamp. The spring or clip 80 has the leg 81 opposite to the leg 79 secured by a fixing screw 92 to a nub 94 at the bottom of the needle holder spaced from the location in which the needle is disposed. This enables the spring clip 80 to be replaced, if necessary, merely by removal of the fixing screw 92.

In use, the needle mounting system is assembled on a tufting machine 10 after the drive mechanism including the latch bar 16 have been mounted. The needle holders 24 are then offered up to the guide plate 52 and are positioned between the ridges 70 formed in the inserts 68, rear edges 50 of the needle holders abutting the inserts in the plate 52. The fixing plate 54 is then removably secured in a position relative to the guide plate 52 to secure the needle holders 24 in position between the guide plate and the fixing plate, in the channels formed between the respective ridges 70 in the elements 68 of the two plates 52, 54. In order to ensure that the drive mechanism and the guide plate 52 are correctly aligned to ensure accurate drive of the needle holders during reciprocation, the position of the guide plate and hence the needle holders is capable of adjustment by movement of a mounting plate 96 relative to the top housing of the head 12, the mounting plate being secured to the linkage 60. Accordingly, the mounting plate 96 and/or the top housing head are provided with apertures (not illustrated) including one of which is elongated so that the mounting plate may be adjustably fastened using a removable fastener which extends through the apertures. Adjustment of the mounting plate 96 relative to the top housing of the head is possible by releasing the fastener and moving the mounting plate relative to the housing, the extent of movement permitted being determined by the dimensions of the elongated slot. Once in the desired position, the fastener may be again tightened. It will be appreciated that since only one guide plate 52 is utilized with a pair of separate ridged guide elements 68, both of the guide elements are removable together and movement of one relative to the other is not permitted. This makes it a much simpler task to accurately align the guide plate 52 with the drive mechanism and ensures to maintain the guide plate in the correct position when aligned. Thus, if the guide plate is accurately aligned with the drive mechanism and is thus releasably secured in position, it acts effectively as a datum for the needle holders 24. Once the correct alignment of the guide plate 52 and the drive mechanism has been achieved, the mounting plate 96 is releasably secured to the top housing of the head maintaining the guide plate in the desired position. The fact that with the present invention adjustment of the position of the guide plate 52 and the driving mechanism is permitted when the machine is set up for operation, or subsequently, provides considerable advantages, particularly as the guide elements 68 are removable together. Firstly, the correct alignment ensures accurate reciprocation of the needle holder 24 between the plates 52, 54 and reduces the likelihood of jamming or locking. Furthermore, the fact that the needle holders 24 are correctly driven aligned with the drive mechanism also reduces the frictional heating of the needle holders which reduces the likelihood of jamming or locking caused by thermal expansion of the various parts. Moreover, since both the guide plate and the fixing plate are modular, it is only necessary to ensure accurate alignment between a small number of needle holders and the latch pin 20 of the drive mechanism.

It will be appreciated that with the present invention, by rendering the most likely parts to fail by wear, or otherwise require replacement, accessible for replacement, it is possible to significantly reduce machine down time and the cost of replacement parts and labor. Additionally, certain of the misalignment problems that may occur in the prior art are alleviated.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modification which do not depart from the spirit of the invention are intended to be included within the scope of the appended claims.

Having thus set forth the nature of the invention, what is claimed herein is:

1. A needle holder for a tufting machine comprising an elongated bar having a pair of spaced apart edges separated by spaced apart substantially planar surfaces and having an upper and a lower end, said lower end including a bore within which a needle may be mounted, and said edges having a curvilinear configuration.

2. A needle holder as recited in claim 1, including a recess formed adjacent said lower end extending from an opening at one of said edges into the needle holder to define an internal wall, a yarn clamp within said recess journally mounted for pivotable movement toward and away from said wall, and a leaf spring fastened to the needle holder outside said recess and having a portion extending into said recess acting on and urging said clamp toward said wall.

3. A needle holder as recited in claim 2, wherein said spring comprises a substantially U-shape member including a pair of spaced apart legs, one of said legs being fastened to said needle holder at the lower end thereof.

4. A needle holder as recited in claim 2, wherein said bore is disposed adjacent the edge opposite said one edge.

5. A needle holder for a tufting machine comprising an elongated bar having a pair of spaced apart edges separated by a pair of surfaces and having an upper and a lower end, said lower end including a bore within which a needle may be mounted, a recess formed adjacent said lower end extending from an opening at one of said edges into the needle holder to define an internal wall, a yarn clamp within said recess journally mounted for pivotable movement toward and away from said wall, and a leaf spring fastened to the needle holder outside said recess and having a portion extending into said recess acting on and urging said clamp toward said wall.

6. A needle holder as recited in claim 5, wherein said spring comprises a substantially U-shape member including a pair of spaced apart legs, one of said legs being fastened to said needle holder at the lower end thereof.

7. A tufting machine comprising a vertically reciprocable needle drive bar, a plurality of needle holders selectively latchable to said bar for reciprocation therewith, each needle holder comprising an elongated bar having a pair of spaced apart edges separated by spaced apart substantially planer surfaces and having an upper and a lower end, each needle holder carrying a respective needle at the lower end, mounting means for supporting and guiding said needle holder for reciprocation in a vertical direction for penetrating a base material moving in a feed direction transverse to said vertical direction, said mounting means comprising first and second guide plates spaced apart in the direction of feed, said plates each having ridges spaced apart in a lateral direction transverse to said vertical direction and to said feed direction, the ridges in said first plate being substantially aligned with the ridges in said second plate to define vertically extending spaced apart channels therebetween, the distance between corresponding ridges in said first and second plates being substantially equal to the distance between said edges of said needle holders, and said ridges and said edges having a curvilinear configuration.

8. A tufting machine as recited in claim 7, wherein one of said plates is adjustable laterally relative to the other.

9. A tufting machine as recited in claim 7, wherein each of said needle holders includes a recess formed in said needle holder adjacent the lower end extending from an opening at one of said edges into the needle holder to define an internal wall, a yarn clamp within said recess journally mounted for pivotal movement toward and away from said wall, and a leaf spring fastened to the needle holder outside said recess and having a portion extending into said recess acting on and urging said clamp toward said wall.

10. A tufting machine as recited in claim 9, wherein said spring comprises a substantially U-shape member including a pair of spaced apart legs, one of said legs being fastened to said needle holder at the lower end thereof.

11. A tufting machine as recited in claim 7, wherein each of said guide plates includes a pair of vertically spaced apart insert members fastened thereto, and said ridges are formed in said inserts.

12. A tufting machine as recited in claim 11, wherein one of said plates is adjustable laterally relative to the other.

* * * * *

UNITED STATES PATENT AND TRADEMARK OFFICE

CERTIFICATE OF CORRECTION

PATENT NO : 5,974,991

DATED : November 2, 1999

INVENTOR(S) : Bardsley

It is certified that error appears in the above-identified patent and that said Letters Patent is hereby corrected as shown below:

In the Title, Tofting should be -- Tufting --.

Signed and Sealed this

Ninth Day of May, 2000

*Attest:*

Q. TODD DICKINSON

*Attesting Officer*

*Director of Patents and Trademarks*